United States Patent [19]

Lorenz

[11] 4,050,990

[45] Sept. 27, 1977

[54] METHOD AND APPARATUS FOR PRODUCING FORM COKE

[75] Inventor: Kurt Lorenz, Hattingen, Germany

[73] Assignee: Firma Carl Still, Germany

[21] Appl. No.: 728,289

[22] Filed: Sept. 30, 1976

Related U.S. Application Data

[63] Continuation of Ser. No. 604,360, Aug. 13, 1975, abandoned.

[30] Foreign Application Priority Data

Aug. 14, 1974 Germany ..... 2439014

[51] Int. Cl.[2] ..... C10B 53/04; C10L 5/02

[52] U.S. Cl. ..... 201/5; 201/21; 201/34; 201/24; 201/28; 201/27; 201/6; 202/126; 202/127; 202/120; 252/373; 423/237; 48/197 R; 48/203; 44/10 C; 44/10 R

[58] Field of Search ..... 201/6, 5, 21, 34, 24, 201/28, 27; 202/126, 127, 120

[56] References Cited

U.S. PATENT DOCUMENTS

| | | | |
|---|---|---|---|
| 1,204,789 | 11/1916 | Kuhn | 201/24 |
| 1,858,135 | 5/1932 | Bowman | 201/15 |
| 2,782,147 | 2/1957 | Bursthein | 201/24 X |
| 2,947,670 | 8/1960 | Hobson | 201/34 |
| 3,674,449 | 7/1972 | Schmalfeld et al. | 44/13 X |
| 3,791,802 | 2/1974 | Holoway | 44/13 |

*Primary Examiner*—James H. Tayman, Jr.
*Attorney, Agent, or Firm*—McGlew and Tuttle

[57] ABSTRACT

A method of producing form coke that is coke having pieces of substantially identical form using a heated shaft furnace comprises mixing fine coke with a caking coal and pressing the mixture at temperatures at which the mixture is plastic in order to form briquettes. The briquettes are permitted to harden and degasify and thereafter they are exposed to a high temperature after hardening for example to a temperature of from 400° to 900° C from 60 to 120 minutes. Thereafter the briquettes are cooled. A first mixing substance is prepared by permitting a fine coal to fall in a non-compressed stream in the shaft furnace while heat is transferred thereto substantially by radiation.

1 Claim, 5 Drawing Figures

METHOD AND APPARATUS FOR PRODUCING FORM COKE

This is a continuation of application Ser. No. 604,360 filed Aug. 13, 1975, now abandoned.

BACKGROUND OF THE INVENTION

1. Field of the Invention

This invention relates in general to the construction of coking devices and in particular to a new and useful method and device for producing form coke.

2. Description of the Prior Art

The invention relates particularly to a method and devices for producing form coke or coke that is made in individual pieces which have a uniform identical shape. In a process of this nature fine coal to be carbonized may be heated in direct contact with hot inert solid or gaseous heat carriers. In such a case gaseous heat carriers are produced by burning fuels of any physical condition, for example, combustion gases, liquid hydrocarbons and coal, and the combustion gases mix with the coal carbonization gases so that only a gas mixture of a low heating power for example 1000 kcal/Nm$^3$ is obtained which can be economically used only in power plants. Rich gas of high calorific power cannot be produced in this way. The method remains tied to the production of a poor gas.

Rich gas can be produced following other known methods in which the fine coal mixtures are heated by direct contact with hot, inert solid heat carriers such as sand or fine coke, that is by mixing with these substances. When a heat carrier which does not contain any carbon is used such a carrier must be separated again from the fine coal before proceeding to the briquette pressing operation. Rich gas may also be produced by moving coal layers which are placed on supports along heated walls of refractory material.

Such methods are very expensive because of the large quantities of abrasive hard substances to be transported in a hot state, and primarily because of the high wear of the transport devices which result therefrom. As compared to the classic retort coking method they offer no economical or technological advantages either.

The retort coking method, for its part, is tied to and dependent on the poor heat conducting capacity of the coal cake in the oven chambers. Also known is a method of heating and degassing fine coal with hydrogen which has been highly heated by atomic heat. This method is economically acceptable only in cases where the residual heat can be utilized to a high degree. This is possible only while using high temperature heat exchanges which introduces economic and technological problems so that this method is used only in very small numbers of circumstances.

SUMMARY OF THE INVENTION

In accordance with the present invention there is provided a method and device for producing fine coal for briquetting fine grained coal mixtures. The coal mixtures are degassed by thermal effect and rich gas is obtained in a simple manner without having to move large quantities of coal or solid heat carriers and without being dependent on the poor heat conducting properties of a coal cake in a discontinuously or continuously operated, horizontal, oblique, or vertical oven chamber.

In accordance with the invention fine coke is produced by carbonizing a non-compressed stream of coal in the course of its free or deflected fall in a shaft furnace and in contrast to the known methods the heat transfer to the coal particles is substantially effected by radiation emanating from the walls of the shaft furnace. Preferably the coal particles are heated within a short time of 1 to 2 seconds up to 800° to 900° C. At the same time the height of the shaft furnace is dimensioned so that during the period of fall in the shaft furnace the coal particles will be degassed as completely as possible. The internal clear dimensions of the shaft furnace for this purpose are for example of a height of 35 meters, a width of 1 meter and a length of approximately 5 meters. The shaft furnace may be operated with fuel gases in a recuperative or regenerative regime.

The fine coke accumulates at the bottom of the shaft furnace and it is drawn off in a well known manner and can be first received in an equalizing bunker before mixing it in a mixer with caking coal. The mixing for example may be in a proportion of 2 to 1 in respect to caking coal and in this operation the fine coal portion is partly degassed.

The mixture formed in a roll press into briquettes of desired shape for example of an egg shape or pillow shaped piece.

The formed briquettes are subsequently hardened and subsequently degasified. It is known to expose the finished briquettes for up to 180 minutes at temperatures of up to 400° C which is approximately the pressing temperature. Due to this provision, the mechanical resistance of the coke briquettes is substantially increased. In accordance with the invention, they are exposed for 60 to 120 minutes to temperatures of up to 900° C. It is particularly advantageous for the subsequent hardening and degasification to expose the briquettes to the action of either the total amount or a part of the uncooled degasification gas. In such a case it is advisable to carry out the treatment for approximately 60 minutes at temperatures of from 450° to 750° C.

During the mixing of the hot fine coke with the caking fine coals but also during the pressing operation and the subsequent hardening, degasification gases are still produced. Advantageously these gases are united with the carbonization gases from the shaft furnace.

The collected degasification gases and coke oven gas having a high calorific value with a variety of compositions, which in a well known manner can be further processed for example by being cooled and freed from dust, water, tar, hydrocarbons ammonia and hydrogen sulfide. Therefore the coke briquettes are cooled down for example in a liquid immersion bath or with inert gases to the ambient temperature. Then the briquettes are ready for use.

In accordance with the invention the briquettes are cooled by circulating inert gases, for example burnt fuel gases and the heat removed from the briquettes is used for heating water for example softened water which may be used inside or outside the plant.

For example the carbonization gases coming from the shaft furnace may be subjected to after heating in the presence of water-steam during which process the hydrocarbons and also the carbon are converted substantially to carbon monoxide and hydrogen. At the same time ammonia is decomposed completely or partly to nitrogen and hydrogen. In accordance with the invention, the water-steam produced during the cooling of the degasification gases is used for this purpose.

Advantageously, catalysts, for example, nickel carrier catalysts are present for supporting the conversion. For approximately the same grinding characteristics, different kinds of fine coal have different coking times. By providing an appropriate grinding, the optimum falling times, that is the coking times can be adjusted in the shaft furnace in each case. Thus for example, a coal having a longer coking time will be ground to a finer grain than a coal having a shorter coking time. In this way longer falling times will be obtained in the shaft furnace in accordance with Stokes' theorem and consequently also longer coking times.

The shaft furnace for carrying out the method in accordance with the invention, is provided at different levels with carbonization gas outlets. Consequently the gases produced during the carbonization, being of unequal composition, can be drawn off at different levels. Gases rich in hydrocarbons can be withdrawn through the upper outlets and gases rich in hydrogen are obtained at the lower outlets.

In accordance with the invention the carbonization gas outlets are designed as connection ducts extending and widening in an obliquely upward direction so that only a minimum quantity of coal and coke dust is entrained by the carbonization gas. In a particular embodiment of the shaft furnace the carbonization gas outlets open into indirectly heatable retorts or spaces to which water and steam supply lines are connected. It is also possible to design the outlet ducts directly in this manner. Preferably the walls of the shafts or the retorts in which the carbonization gases are cracked are made of a refractory material having a high coefficient of thermal conductivity. Such material usually comprises a silicon carbide or aluminum oxide (corundum substance), for example.

Accordingly it is an object of the invention to provide an improved method of producing form coke or coke having pieces of substantially identical form using a heated shaft furnace which comprises preparing a first mixing substance by heating a fine coal in a shaft furnace by permitting it to drop in a non-compressed stream freely therein while heat is transferred to the coal substantially by radiation, mixing the fine coke which is formed by the heating with a caking coal, pressing the mixture at temperatures at which the mixture is plastic to form briquettes, permitting the briquettes to harden and degasify, exposing the briquettes to a high temperature after hardening, and subsequently cooling the briquettes.

A further object of the invention is to provide an apparatus for producing form coke which includes an elongated shaft furnace having a vertical shaft passage for falling coal which is permitted to fall therein and having heating flues or regenerative or recuperative gases with offtakes from the furnace at different levels and wherein the shaft furnace has a height of approximately 35 meters, a width of approximately 1 meter and a length of approximately 5 meters and wherein the offtakes extend obliquely upwardly and of cross-sections which widen upwardly.

A further object of the invention is to provide an apparatus for producing form coke which is simple in design, rugged in construction and economical to manufacture.

The various features of novelty which characterize the invention are pointed out with particularity in the claims annexed to and forming a part of this disclosure. For a better understanding of this invention, its operating advantages and specific objects attained by its uses, reference should be had to the accompanying drawing and descriptive matter in which there are illustrated preferred embodiments of the invention.

GENERAL DESCRIPTION OF THE PREFERRED EMBODIMENT

Figure 1:
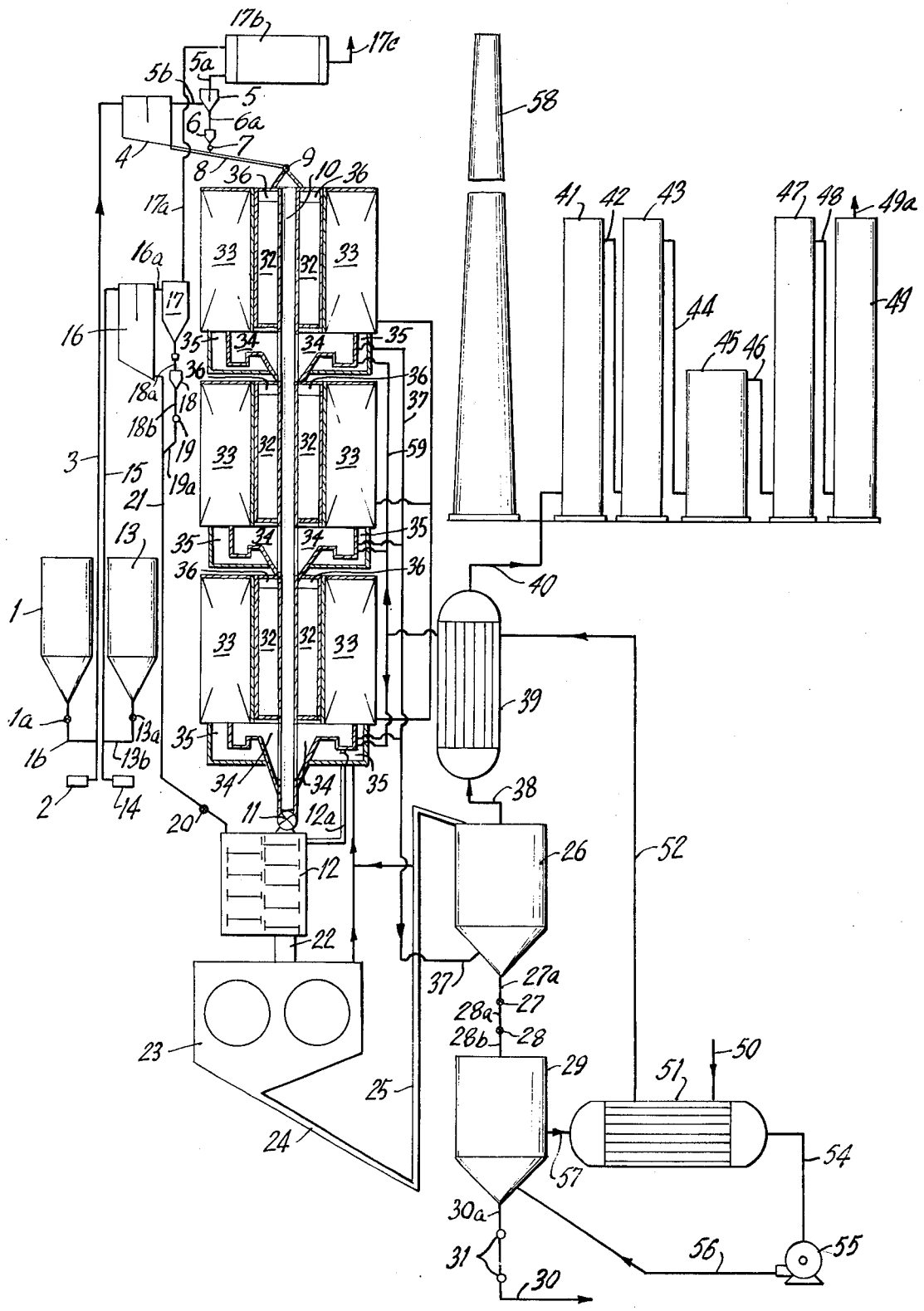
FIG. 1 is a schematic drawing indicating the plant for producing form coke including a shaft furnace with the associated supplying, drying and transportation equipment for the coal as well as for the gas.

As best seen in FIG. 1 a non-caking fine coal is contained in a bunker 1 and it contains volatile components. The coal is supplied through a bucket wheel lock 1*a* and a line 1*b* into a line 3 which also functions at the same time as a dryer for the coal. A hot inert gas stream is produced in a combustion furnace 2 and the hot gas conveys the fine coal and also subjects it to a preliminary drying and the two products move to a separator 4. The products then pass through a line 8 and a feeder 9 into the shaft furnace 10 where a fine coke is formed which is discharged from the shaft furnace 10 through a discharge lock 11 and falls into a mixer 12.

A bituminous caking fine coal is stored in a bunker 13 and is supplied through a feed line 13*a* and line 13*b* into a line 15 which also serves as a dryer. A gas furnace 14 produces a hot inert gas stream which conveys and dries the caking fine coal and moves it into a bunker 16. The bunker 16 is connected through a short line 16*a*, a cyclone separator 17 and a line 17*a* to a final separator 17*b* which is an electrofilter. The electrofilter 17*b* discharges the purified waste gas through the line 17*c* into the open air.

Separator 4 is connected through a line 5*b* to a cyclone 5 which is further connected through a line 5*a* to the separator 17*b* so that the gas from the line 3 is also purified in separator 17*b*. The dust accumulated in the cyclone 5 is supplied through a line 6*a* to an intermediate bunker 6 and a bucket wheel lock 7 into a line 8 and passes through line 8 and 9 into the shaft furnace 10. The coal dust accumulated in the cyclone 17 passes through a line 18*a*, an intermediate bunker 18, a line 18*b*, a lock 19 and a line 19*a* into line 21 which connects through a lock 20 the bunker 16 to the mixer 12 and conducts the predried bituminous caking coal to the mixer 12.

In the mixer 12 the caking coal is mixed with the coke dust, the fine coke cools down and the caking coal is heated up to the plastic range temperature. In this state, the mixture is fed through a conduit 22 into a roll press 23. The degasification gases produced in a mix 12 are conducted through a line 12*a* in the carbonization gas offtakes 34 of shaft 10. The pressed briquettes pass from the roll press 23 through a chute 24 and are transported by an elevator 25 to a bin 26 for after hardening. Bin 26 is supplied through a line 37 with hot degasification gases from the carbonization gas offtakes 34 of the shaft furnace 10. After the briquettes remained in the after hardening bin 26 for 60 minutes at temperatures in the range of from 450° C to 750° C, they are discharged through a line 27*a*, lock 27, line 28*a*, lock 28 and line 28*b* into a cooling bunker 29 where circulation of the inert cooling gas is maintained through lines 54, 56 and 57 and a blower 55 and a water preheater 51. The water preheater 51 is supplied with a softened water through a line 50. The preheated water is drawn off through a line 52. The cooled briquettes are discharged through a conduit 30*a*, double lock 31 and outlet 30 and delivered for further use.

The hot degasification gas coming from line 37 and passing through the bin 26 for subsequent hardening, leaves the bin through a line 38 and is cooled down in an evaporator 39 by the water coming through line 52. The water in line 52 is thereby vaporized. The cooled degasification gas leaves the evaporator 39 through a line 40 and passes consecutively through a soot washer 41, a line 42, a preliminary cooler 43, a line 44, an electrofilter 45, a line 46, a hydrogen sulfide washer 47, a line 48 and into an ammonia rewasher 49 where it is conducted through line 49*a* for further use.

Figure 2:
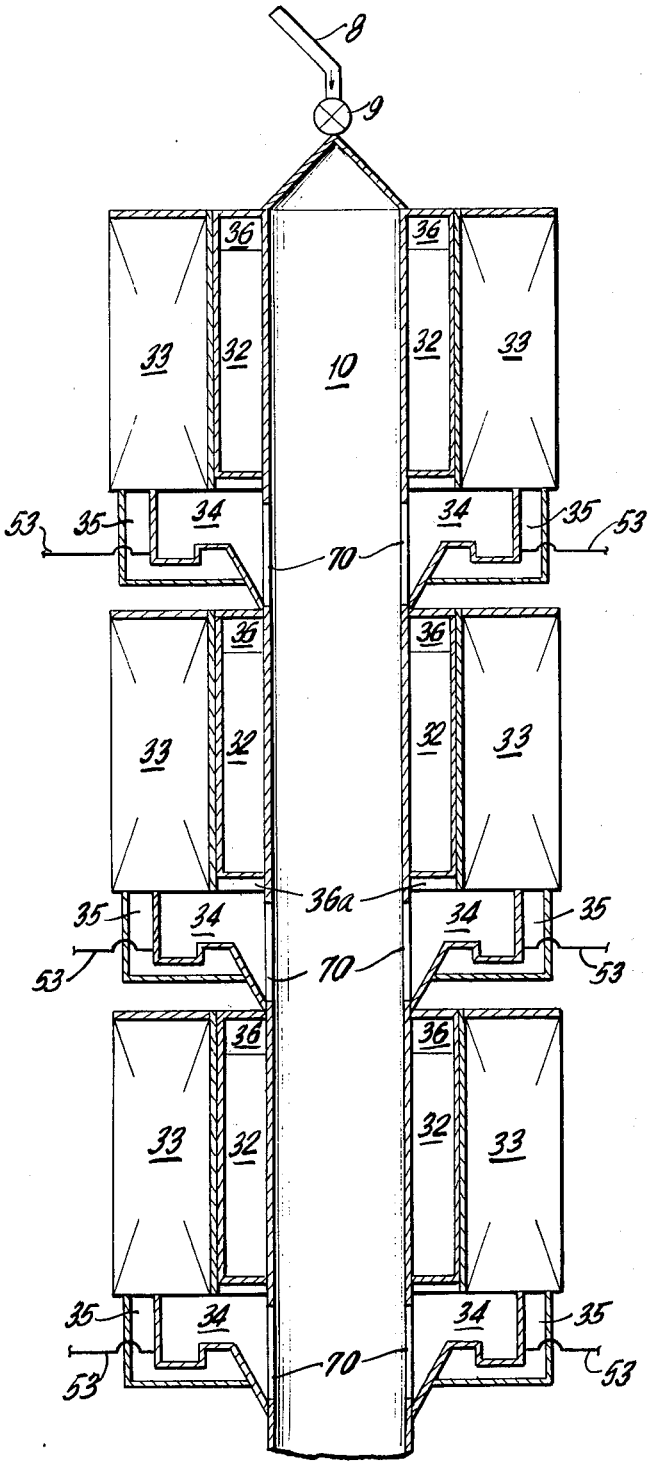
FIG. 2 is a diagrammatic view of the shaft furnace on a larger scale than shown in FIG. 1.

In FIG. 2 the carbonization gas offtakes 34 of the shaft furnace are shown which are designed as heatable collecting retorts. Their sloping walls have an inclination of approximately 60°. Heating flues 32, regenerators 33, gas heating flues 35 for the gas collecting retorts or carbonization gas offtakes 34, bottom flues 36*a* and horizontal top flues for collecting and distributing the burnt combustion gases which, after having passed through the regenerators 33, are conducted, through further lines which are not shown through the chimney 58 as shown in FIG. 1 from where they escape into the opening air. The branched steam lines 53 coming from the evaporator 39 open into the collecting offtakes 34. The shaft furnace 10 is provided with carbonization gas offtakes 34 at various elevations along its height. By addition of steam, the hydrocarbons decomposing in the degasification gases as well as the elementary carbon are converted to form carbon monoxide and hydrogen. At the same time ammonia is also partly or completely decomposed.

Figure 3:
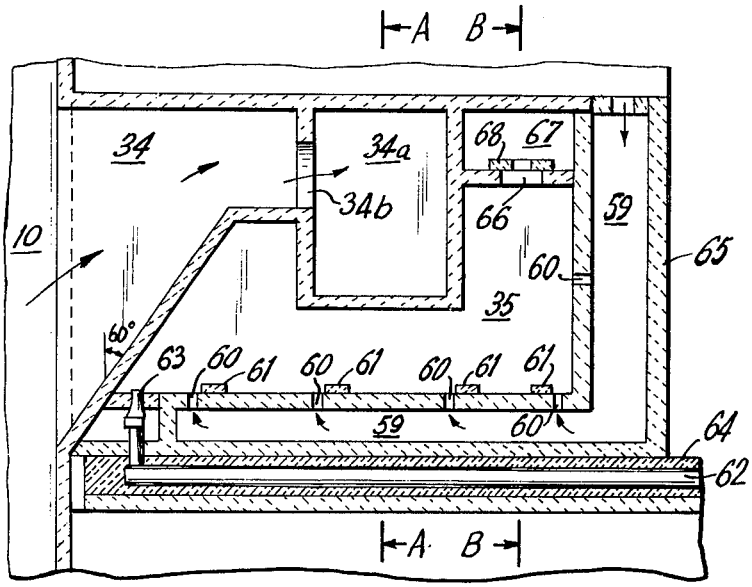
FIG. 3 is an enlarged vertical sectional view of the heating system of the degasification offtakes.
Figure 4:
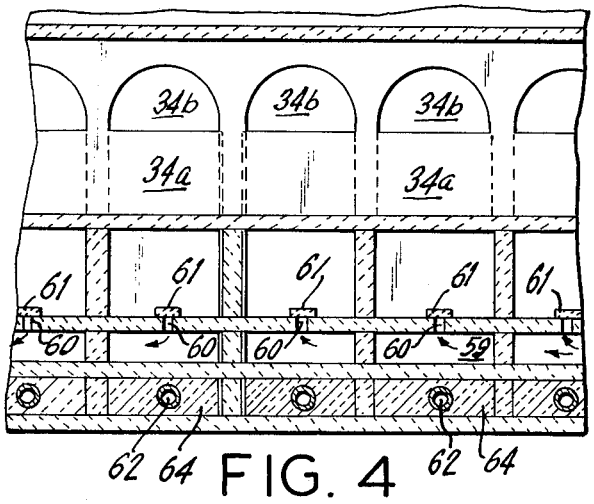
FIG. 4 is a vertical sectional view taken along the line A—A of FIG. 3.
Figure 5:
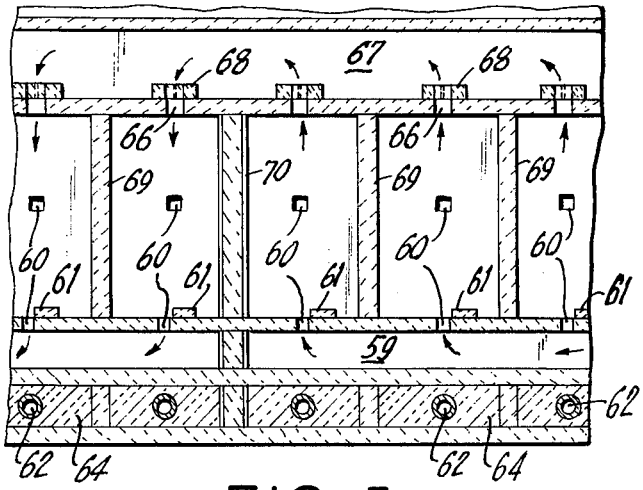
FIG. 5 is a vertical sectional view taken along the line B—B of FIG. 3.

FIGS. 3 to 5 show details of the heating system. These figures show a cross duct 34*a* for collecting degasification gases, gas passages 34*b*, air supply passages 59 for the heating flues 35, air nozzles 60, slide bricks 61 for varying the free cross-sectional area of the nozzles, a rich gas supply line 62 which is protected by thermal insulation 64, a rich gas nozzle 63 which fires into the heating flue 35, the masonry 65, passages 66 into the horizontal top flue 67, the cross-sectional areas of which can be varied by means of slide bricks 68, supporting beams 69 for the heating flues, and a central separating wall 70 such as is usual in partitioned regenerative heating systems of coke ovens.

In accordance with the method of the invention coke of substantially uniform identical pieces is formed first by preparing a first mixing substance by directing a non-caking fine coal after it has been heated by an inert gas into the top of a shaft furnace which has a clear height in the furnace of 35 meters. The fine coal is permitted to fall as a non-compressed stream of fine coal in the shaft furnace and the heat is transferred to the coal substantially by radiation. The fine coke which is formed is mixed with a caking coal and the mixture is pressed at temperatures in which the materials are plastic to form briquettes of identical size. The briquettes are permitted to harden and degasify and then they are exposed to a high temperature after hardening and subsequently cooled. The cooled particles are heated within 1 or 2 seconds up to 800° to 900° C. After hardening the briquettes are exposed for 60 to 120 minutes to temperatures of from 400° to 900° C. The briquettes which are formed are exposed to the action of at least a portion of the uncooled degasification gases. The after hardening treatment of the briquettes is carried out for 60 minutes at a temperature of from 450° to 750° C.

The degasification gases which are still produced during the mixing of the fine coke with the caking fine coals as well as during the briquetting pressing operation and, after the hardening operation, are conveyed so as to unite with the degasification gases obtained in the carbonization process and they are further conjointly processed therewith.

The briquettes are advantageously cooled by circulating inert gases and the heat withdrawn from the briquettes is used for heating water for example softened water. The degasification gases are cooled with water to form steam. Preheated water is used as a cooling water for cooling the briquettes. Degasification gases from the shaft furnace or after heater are after heated in the presence of water or steam during which process the hydrocarbons contained in the degasification gases as well as carbon are converted substantially into carbon monoxide and hydrogen. During the conversion of the hydrocarbons and carbon catalysts are present such as nickel carrier catalyst. Steam is used to convert the hydrocarbons and preferably steam which has been produced by cooling the degasification gases.

The shaft furnace gas offtakes are adapted to be provided with steam inlets so they can open into spaces or retorts which are equipped in this manner. The shaft furnace and the gas offtakes or parts thereof are advantageously made of a heat conducting material which contains silicon carbide or aluminum oxide.

What is claimed is:

1. A method of producing form coke pieces having uniformly mutually identical shape, comprising directing a non-compressed stream of fine coal into the top of a shaft furnace and permitting it to fall downwardly therein so as to permit the hot walls of the furnace to radiate heat to the fine coal and at a rate and temperature such that the fine coal is heated within 1 or 2 seconds up to from 800° to 900° C, permitting the fine coal to fall through a height within the shaft furnace to cause the coal particles to become degassed as completely as possible, permitting the fine coal which is formed to accumulate at the bottom of the shaft furnace and regularly withdrawing the accumulated quantities of coal particles and mixing it with caking coal in a mixer in proportions of about two parts of fine coke to one part of caking coal while the fine coke is still hot so that the caking coal becomes partly degassed and forms a mixture with the fine coke, drawing off the carbonization gases at various elevations throughout the shaft furnace and separating the gases drawn at the upper levels which are rich in hydrocarbons from the gases drawn at the lower levels which are richer in hydrogen, collecting the carbonization gases and subjecting them to an after heating in the presence of water and steam so as to convert the hydrocarbons and carbon substantially to carbon monoxide and hydrogen and at the same time to decompose the ammonia gases which are formed to nitrogen and hydrogen with the aid of the water and steam, adding a catalyst such as a nickel carrier catalyst to the carbonization gases, directing the withdrawn carbonization gases through connecting ducts which widen in an obliquely upwardly extending direction so that only a minimum quantity of coal and coke dust is entrained by the carbonization gases withdrawn, and directing the carbonization gases into heatable retorts into which steam and water is supplied, pressing the mixture into a coke briquette, exposing the finished briquette to temperatures of up to 400° for 180 minutes so as to harden the briquettes and increase the mechanical resistance of the coke briquettes, and thereafter exposing the coke briquettes to temperatures of up to 900° C for from 60 to 120 minutes for an after hardening of the coke briquettes during which degasification gases are still produced, and thereafter permitting the coke briquettes to cool, recirculating the decarbonization gases back into the shaft furnace, and cooling the briquettes by circulating inert gases over the briquettes and circulating the inert gases which have been heated by the briquettes in heat exchange relationship with water for heating the water.

* * * * *